US006312497B1

(12) United States Patent
Standaert

(10) Patent No.: US 6,312,497 B1
(45) **Date of Patent: *Nov. 6, 2001**

(54) PRE-ALLOYED, COPPER CONTAINING POWDER, AND ITS USE IN THE MANUFACTURE OF DIAMOND TOOLS

(75) Inventor: Roger Standaert, Olen (BE)

(73) Assignee: N. V. Union Miniere S.A., Brussels (BE)

( * ) Notice: Subject to any disclaimer, the term of this patent is extended or adjusted under 35 U.S.C. 154(b) by 0 days.

This patent is subject to a terminal disclaimer.

(21) Appl. No.: 09/425,294

(22) Filed: Oct. 25, 1999

Related U.S. Application Data

(63) Continuation of application No. PCT/EP98/02364, filed on Apr. 22, 1998.

(30) Foreign Application Priority Data

Apr. 29, 1997 (WO) ..... 97201251

(51) Int. Cl.[7] ..... B22F 3/00

(52) U.S. Cl. ..... 75/255; 419/23; 419/11; 75/255; 75/246

(58) Field of Search ..... 75/246, 241, 243, 75/255; 419/11, 23

(56) References Cited

U.S. PATENT DOCUMENTS 2,238,351 * 4/1941 Van Der Pyl .
2,410,512 * 11/1946 Lindquist et al. .
4,049,380 9/1977 Yih et al. ..... 428/539.5
4,231,762 11/1980 Hara .

FOREIGN PATENT DOCUMENTS 53-37992 4/1978 (JP) .
1689053 11/1991 (SU) .

OTHER PUBLICATIONS

Engström et al., "Powders and processes for high performance PM steels", *Powder Metallurgy*, vol. 35, No. 1, 1992, pp. 67–72.

Tsuchiya et al., "Copper–Iron Alloy Binder in Diamond Tools for Cutting and Polishing of Fine Ceramics", Chemical Abstracts, vol. 108, No. 22, May 30, 1988, Columbus, Ohio, US, Abstract No. 191222, see abstract & JP 62 287 035 A (Fuji DIE Co., Ltd., Japan).

* cited by examiner

*Primary Examiner*—Daniel J. Jenkins
(74) *Attorney, Agent, or Firm*—Antonelli, Terry, Stout & Kraus, LLP

(57) ABSTRACT

The present invention relates to the use of a pre-alloyed powder as a binder in the manufacture of diamond tools by hot sintering. This powder is characterized in that it has an average particle size of less than 10 $\mu$m as measured with the Fisher SSS and loss of mass by reduction in hydrogen of less than 2% as measured according to the standard ISO 4491-2:1989 and in that it contains, in % by weight, up to 40% of cobalt, up to 50% of nickel, from 5 to 80% of iron and from 5 to 80% of copper; the other components in the powder consist of unavoidable impurities.

9 Claims, No Drawings

PRE-ALLOYED, COPPER CONTAINING POWDER, AND ITS USE IN THE MANUFACTURE OF DIAMOND TOOLS

REFERENCE TO RELATED APPLICATION

This application is a continuation of copending international application number PCT/EP98/02364 designating the United States of America, filed Apr. 22, 1998.

The present invention relates to the use of a pre-alloyed powder as a binder in the manufacture of diamond tools by hot sintering.

TECHNICAL FIELD

BACKGROUND AND SUMMARY

In the manufacture of diamond tools by hot sintering, with or without pressure applied, of an intimate mixture of diamonds and of a binder material, use is made for the binder phase, that is the material forming the matrix of the tool after the sintering operation, either of fine cobalt powders (from less than 1 to about 6 μm in diameter as measured with the Fisher Sub Sieve Sizer, called hereafter Fisher SSS) or of mixtures of fine powders, such as mixtures of fine cobalt, nickel and iron powders, or of coarse pre-alloyed powders, such as steel powders obtained by atomization of a melt.

The use of fine cobalt powder gives very good results from a technical standpoint; its major drawback stems from the high price fluctuations of the cobalt powder.

Using mixtures of fine powders, matrices are obtained whose strength, hardness and wear resistance are relatively low. The use of coarse pre-alloyed powders (from 10 to 50 μm) requires high sintering temperatures, in the order of 1000 to 1300° C., at which temperatures severe degradation of the diamonds takes place, resulting in weakened diamond crystals and poor retention of the diamonds in the matrix.

In SU-A-1689053 an iron-based metallic binder for diamond tools with improved tool performance, and containing Ni, Cu and C and Sn, is described. No specifications are given concerning the preparation of the binder and the characteristics of the powders involved.

The object of the present invention is to provide fine pre-alloyed powders, containing copper and iron as two of the alloying elements, and with less or no dependence on cobalt, whose use as a binder in the manufacture of diamond tools by hot sintering avoids the aforementioned drawbacks.

DETAILED DESCRIPTION

For this purpose, the new pre-alloyed powder used according to the invention has an average particle size of less than 10 μm, as measured with the Fisher SSS, and a loss of mass by reduction in hydrogen of less than 2%, as measured according to the standard ISO 4491-2:1989. The powder contains, in % by weight, up to 40% of cobalt, up to 50% of nickel, from 5 to 80% of iron and from 5 to 80%, of copper, the other components in the powder consisting of unavoidable impurities. It has been found that such a powder may be sintered at moderate temperatures, i.e. from 600 to 1000° C., giving a high hardness and a good resilience, which may be adapted to the particular requirements of the users of diamond tools, by varying the composition of the powder.

It is necessary for the particle size to be less than 10 μm as measured with the Fisher SSS, in order that the powder be sinterable at moderate temperatures; advantageously it is less than 5 μm.

The loss of mass by reduction in hydrogen of less than 2% corresponds to a sufficiently low oxygen content; higher oxygen contents would allow the diamonds to degrade during the sintering operation.

The abovementioned cobalt, nickel, iron and copper contents are necessary to obtain a sintered matrix with a suitable hardness and resilience, i e. in the order of the hardness and resilience offered by sintered fine cobalt powder. Particularly, it has been found that the incorporation of copper into the pre-alloyed powder results in a less brittle matrix than when copper is omitted. Preference is given to a cobalt content of up to 30%, a nickel content of up to 30%, an iron content of at least 10%, and a copper content of at least 10%.

The powder of the invention may be prepared by heating, in a reducing atmosphere, a hydroxide, oxide, carbonate, basic carbonate (a mixture of hydroxide and carbonate), an organic salt, or a mixture of two or more of these compounds, of the constituents of the alloy ("constituents of the alloy" denotes all the metallic elements present in the alloy).

The hydroxide, carbonate, basic carbonate and organic salt may be prepared by adding an aqueous solution of the constituents of the alloy to an aqueous solution of, respectively, a base, a carbonate, a base and a carbonate, and a carboxylic acid, separating the precipitate thus obtained from the aqueous phase and drying the precipitate.

The aqueous solution of the constituents of the alloy may be a chloride solution, a sulfate solution, a nitrate solution or a mixed solution of these salts.

EXAMPLE 1

This example relates to the preparation of a powder according to the invention by the precipitation of a mixed hydroxide and the subsequent reduction of this hydroxide.

To 440 liters of an aqueous solution of sodium hydroxide containing 45 g/l of NaOH, 110 liters of a mixed chloride-sulfate solution containing 10.5 g/l of cobalt, 73.5 g/l of iron and 21 g/l of copper are added at 80° C. and with stirring. Virtually all of these metallic elements are precipitated in the form of a mixed hydroxide. This precipitate is separated by filtration, washed with water, and dried. The dried precipitate contains 6.6% of cobalt, 46.3% of iron and 13% of copper. The precipitate is reduced in a furnace at 600° C., in a stream of hydrogen, for 7.5 hours. A powdery metallic product (powder No. 1) is obtained in this manner, containing 10% of cobalt, 69.9% of iron, 19.6% of copper and 0.4% of oxygen. The powder particles have an average diameter of 4.2 μm, measured with the Fisher SSS. The specific surface of the powder, measured by the BET method, according to DIN 66132, is 0.43 $m^2/g$.

EXAMPLE 2

This example relates to the preparation of a powder according to the invention by the precipitation of a mixed hydroxide and the subsequent reduction of this hydroxide.

To 410 liters of an aqueous solution of sodium hydroxide containing 45 g/l of NaOH, 114 liters of a mixed chloride-sulfate solution containing 26.9 g/l of cobalt, 8.3 g/l of nickel, 14 g/l of iron and 53.5 g/l of copper are added at 80° C. and with stirring. Virtually all of these metallic elements are precipitated in the form of a mixed hydroxide. This precipitate is separated by filtration, washed with water, and dried. The dried precipitate contains 15.4% of cobalt, 4.8% of nickel, 8% of iron and 30.7% of copper.

The precipitate is reduced in a furnace at 600° C., in a stream of hydrogen, for 7.5 hours. A powdery metallic product (powder No. 2) is obtained in this manner, containing 26% of cobalt, 8.1% of nickel, 13.5% of iron, 51.8% of copper and 0.3% of oxygen. The powder particles have an average diameter of 2.9 μm, measured with the Fisher Sub Sieve Sizer. The specific surface of the powder, measured by the BET method, is 0.71 $m^2/g$.

EXAMPLE 3

This example relates to a series of tests comparing the sinterability of the powders of examples 1 and 2.

Disk-shaped compacts, diameter 20 mm, were sintered by pressing for 3 minutes at 650, 750, 850 and 950° C. in graphite molds, under a pressure of 35 Mpa. The density and the Vickers hardness of the sintered pieces were measured. The results of the measurements are given in the Table 1 below.

TABLE 1

| Powder n° | Sintering temperature ° C. | Density $g/cm^3$ | Vickers hardness HV10 |
|---|---|---|---|
| 1 | 650 | 7.735 | 241 |
| 1 | 750 | 7.984 | 261 |
| 1 | 850 | 7.979 | 212 |
| 1 | 950 | 8.017 | 239 |
| 2 | 650 | 8.434 | 256 |
| 2 | 750 | 8.804 | 238 |
| 2 | 850 | 8.595 | 221 |
| 2 | 950 | 8.639 | 196 |

The results show that densities close to the theoretical density of the alloys (97 to 98% of theoretical density) can be obtained by sintering under pressure and that the sintered compacts have a hardness situated in a range fit for diamond tool manufacturing.

EXAMPLE 4

In this example bar-shaped compacts were sintered in the same conditions as example 3. Density and resilience (unnotched Charpy test) of the sintered bars are shown in Table 2 below.

TABLE 2

| Powder n° | Sintering temperature ° C. | Density $g/cm^3$ | Resilience $J/cm^2$ |
|---|---|---|---|
| 1 | 650 | 7.911 | 23.4 |
| 1 | 650 | 7.955 | 22.5 |
| 1 | 750 | 7.937 | 45.9 |
| 1 | 750 | 7.943 | 95.2 |
| 1 | 850 | 7.858 | 60.6 |
| 1 | 850 | 7.994 | 86.2 |
| 1 | 950 | 7.975 | 43.4 |
| 1 | 950 | 7.945 | 51.6 |
| 2 | 650 | 8.515 | 19.1 |
| 2 | 650 | 8.547 | 12.0 |
| 2 | 750 | 8.599 | 52.4 |
| 2 | 750 | 8.489 | 91.0 |
| 2 | 850 | 8.618 | 59.0 |
| 2 | 850 | 8.546 | 95.9 |
| 2 | 950 | 8.347 | 75.0 |
| 2 | 950 | 8.359 | 71.0 |

Extra Fine Cobalt powder produced by Union Minière, which is considered as the standard powder for the manufacture of diamond tools, was sintered in the same conditions as the pre-alloyed powders Extra Fine Cobalt powder has an average diameter of 1.2–1.5 μm as measured with the Fisher SSS. Its oxygen content is between 0.3 and 0.5%. Its cobalt content is at least 99.85%, excluding oxygen, the balance being unavoidable impurities. The resilience values on unnotched bars are shown in Table 3.

TABLE 3

| Sintering temperature ° C. | Vickers hardness HV10 | Resilience $J/cm^2$ |
|---|---|---|
| 650 | 200 | 49–56 |
| 750 | 280 | 64–101 |
| 850 | 280 | 87–123 |
| 950 | 240 | 92–109 |

With Cobalt Mesh powder, a coarser powder also produced by Union Minière with an average diameter of 4–5.5 μm as measured with the Fisher SSS, which is the binder in cutting tools used for less severe cutting conditions, the resilience values are shown in Table 4.

TABLE 4

| Sintering temperature ° C. | Vickers hardness HV10 | Resilience $J/cm^2$ |
|---|---|---|
| 650 | | 3–3.3 |
| 750 | | 6.1–6.8 |
| 850 | 250 | 32.2–32.5 |
| 950 | 220 | 44.3–59.4 |

The resilience values obtainable with the powders of the invention lie between those of the fine and the coarse cobalt powders produced by Union Minière.

EXAMPLE 5

In this example the influence of copper on the properties of sintered compacts is illustrated. Three pre-alloyed powders with the same ratios of cobalt, nickel and iron contents, produced following the production method described in examples 1 and 2, were sintered by hot pressing during 3 minutes at a pressure of 35 Mpa, at temperatures between 650 and 950° C.

The composition of the three powders, in weight percent, is as follows:

- powder No. 3 contains 10% cobalt, 20% nickel and 70% iron;
- powder No. 4 contains 8% cobalt, 16% nickel, 56% iron and 20% copper;
- powder No. 5 contains 6% cobalt, 12% nickel, 42% iron and 40% copper.

TABLE 5

| Powder n° | Sintering temperature ° C. | Density $g/cm^3$ | Vickers hardness HV10 |
|---|---|---|---|
| 3 | 650 | 6.761 | 249 |
| 3 | 700 | 7.575 | 372 |
| 3 | 750 | 7.811 | 440 |
| 3 | 800 | 7.821 | 436 |
| 3 | 850 | 7.829 | 448 |
| 3 | 900 | 7.841 | 439 |
| 3 | 950 | 7.837 | 489 |
| 4 | 650 | 7.622 | 259 |
| 4 | 750 | 8.039 | 341 |
| 4 | 850 | 8.030 | 364 |

TABLE 5-continued

| Powder n° | Sintering temperature ° C. | Density g/cm$^3$ | Vickers hardness HV10 |
|---|---|---|---|
| 4 | 950 | 8.064 | 392 |
| 5 | 650 | 7.878 | 255 |
| 5 | 750 | 8.132 | 311 |
| 5 | 850 | 8.132 | 320 |
| 5 | 950 | 8.141 | 327 |

Alloys No. 1 and 3 have the same Co and Fe contents, while the balance is Cu in alloy No. 1 and Ni in alloy No. 3. The hardness of the sintered alloy No. 3, without Cu, is very high compared to that of alloy No. 1, with Cu. Its hardness may even be too high for application in diamond tools and it may also be too brittle. Adding Cu to the hard alloy No. 3 raises the densities of the sintered compacts when sintered at the same temperature, while the hardness is lowered by adding more copper. The hardness can thus be controlled by incorporating a certain quantity of copper into the alloyed powder. Also, the resulting compacts are less brittle.

EXAMPLE 6

This example illustrates the advantage of using pre-alloyed powders for sintering instead of mixtures of elemental metal powders. It shows the properties of sintered compacts made from mechanically mixed, fine elemental metal powders, for comparison with the properties of sintered compacts made from pre-alloyed powders according to the invention. The powder mixtures 6 to 10 were composed from elemental powders of cobalt, nickel, iron and copper, in order to obtain the same chemical compositions as the pre-alloyed powders 1 to 5 of the previous examples, and mixed homogeneously in a Turbula mixer. The average diameter, $d_{50}$, of the mixtures, measured by laser diffraction (Sympatec method) is between 5.3 and 7.5 $\mu$m. The mixtures were sintered by heating under pressure, into unnotched bars, in the same conditions as the aforementioned pre-alloyed powders. Table 6 shows the results.

TABLE 6

| Powder mixture n° | Equivalent pre-alloyed powder n° | Sintering temperature ° C. | Density g/cm$^3$ | Vickers hardness HV10 |
|---|---|---|---|---|
| 6 | 1 | 750 | 7.558 | 118 |
| 6 | 1 | 750 | 7.641 | 101 |
| 6 | 1 | 850 | 7.035 | 67 |
| 6 | 1 | 850 | 6.834 | 62 |
| 7 | 2 | 750 | 8.471 | 120 |
| 7 | 2 | 750 | 8.457 | 101 |
| 7 | 2 | 850 | 8.504 | 144 |
| 7 | 2 | 850 | 8.485 | 141 |
| 8 | 3 | 750 | 7.436 | 113 |
| 8 | 3 | 750 | 7.480 | 119 |
| 8 | 3 | 850 | 7.460 | 106 |

TABLE 6-continued

| Powder mixture n° | Equivalent pre-alloyed powder n° | Sintering temperature ° C. | Density g/cm$^3$ | Vickers hardness HV10 |
|---|---|---|---|---|
| 8 | 3 | 850 | 7.627 | 121 |
| 9 | 4 | 750 | 7.441 | 109 |
| 9 | 4 | 750 | 7.705 | 115 |
| 9 | 4 | 850 | 7.172 | 84 |
| 9 | 4 | 850 | 7.265 | 92 |
| 10 | 5 | 750 | 7.884 | 109 |
| 10 | 5 | 750 | 7.857 | 117 |
| 10 | 5 | 850 | 7.720 | 100 |
| 10 | 5 | 850 | 7.757 | 102 |

This example shows that sintering powder mixtures results in metal compacts with inferior hardness compared to the hardness of pre-alloyed powders with the same global composition. Also, the resilience of de sintered powder mixture is expected to be poor.

What is claimed is:

1. In a method of manufacturing diamond tools comprising hot sintering a mixture of diamonds and a binder material, the improvement comprising using a pre-alloyed powder as a binder material, wherein the powder has an average particle size of less than 10 $\mu$m as measured with the Fisher Sub Sieve Sizer and a loss of mass by reduction in hydrogen of less than 2% as measured according to the standard ISO 4491-2:1989 and the powder contains, in % by weight, up to 40% of cobalt, up to 50% of nickel, from 5 to 80% of iron and from 5 to 80% of copper, the other components in the powder consisting of unavoidable impurities.

2. The method according to claim 1, wherein the powder has an average particle size of less than 5 $\mu$m.

3. The method according to claim 1, wherein the powder contains at least 10% of copper.

4. The method according to claim 1, wherein the powder contains at least 10% of iron.

5. The method according to claim 1, wherein the powder contains at least 30% of cobalt.

6. The method according to claim 1, wherein the powder contains at least 30% of nickel.

7. The method according to claim 1, including preparing the powder by heating a mixed hydroxide of constituents of the powder in a reducing atmosphere.

8. The method according to claim 1, wherein sintering is carried out at 600–1000° C.

9. Pre-alloyed powder having an average particle size of less than 10 $\mu$m as measured with the Fisher SSS and a loss of mass by reduction in hydrogen of less than 2% as measured according to the standard ISO 4491-2:1989 and containing, in % by weight, up to 40% of cobalt, up to 50% of nickel, from 5 to 80% of iron and from 5 to 80% of copper, the other components in the powder consisting of unavoidable impurities.

* * * * *